US008534513B1

(12) United States Patent
Dixon

(10) Patent No.: US 8,534,513 B1
(45) Date of Patent: Sep. 17, 2013

(54) TIME ORGANIZING CLOTHES HANGER

(71) Applicant: Donald Dixon, Pittsburgh, PA (US)

(72) Inventor: Donald Dixon, Pittsburgh, PA (US)

( * ) Notice: Subject to any disclaimer, the term of this patent is extended or adjusted under 35 U.S.C. 154(b) by 0 days.

(21) Appl. No.: 13/669,552

(22) Filed: Nov. 6, 2012

(51) Int. Cl.
*A41D 27/22* (2006.01)

(52) U.S. Cl.
USPC ..... 223/91; 223/88; 223/93; 223/96; 223/DIG. 4

(58) Field of Classification Search
USPC ..... 223/85, 88, 91, 92, 95, DIG. 4, 93, 223/96; D6/315
See application file for complete search history.

(56) References Cited

U.S. PATENT DOCUMENTS

| | | | | | |
|---|---|---|---|---|---|
| 2,232,249 | A * | 2/1941 | Losin | 223/85 |
| 3,124,284 | A | 3/1964 | Collum | |
| 4,382,531 | A * | 5/1983 | Bisk et al. | 223/91 |
| 4,685,572 | A * | 8/1987 | Jamison | 223/85 |
| 4,756,104 | A * | 7/1988 | Bailey | 223/85 |
| 4,791,743 | A * | 12/1988 | Kleinke | 40/322 |
| 4,886,010 | A * | 12/1989 | Stutzman | 223/85 |
| 5,096,101 | A | 3/1992 | Norman et al. | |
| 5,305,933 | A | 4/1994 | Zuckerman | |
| 5,526,968 | A * | 6/1996 | Larson | 223/88 |
| 5,564,361 | A * | 10/1996 | Satterwhite | 116/308 |
| 6,202,906 | B1 | 3/2001 | Zuckerman | |
| 6,330,969 | B1 * | 12/2001 | Villaraut | 235/64.7 |
| 6,612,000 | B2 | 9/2003 | Housley | |
| D527,194 | S | 8/2006 | Yau | |
| 7,246,730 | B2 * | 7/2007 | Russo | 223/85 |
| 2005/0224532 | A1 | 10/2005 | Russo | |
| 2007/0084889 | A1 | 4/2007 | Fleming | |

OTHER PUBLICATIONS

Lillian Vernon, Days-of-the-Week Kids Clothes Hangers, Oct. 19, 2011 (Wayback Machine), www.lillianvernon.com/Product/DaysoftheWeekClothesHangers.*
Wayback Machine Cover Page For Lillian Vernon, Oct. 19, 2011.*

* cited by examiner

*Primary Examiner* — Nathan Durham

(57) ABSTRACT

The time organizing clothes hanger involves a system for hanging garments, which also keeps track of when a garment was last worn or when a garment is to be worn or when a garment is due to be laundered. The time organizing system utilizes sliding panels that connect into and slide along sliding channels located on the clothes hanger. The sliding panels keep track of and indicate a particular day, month, and current status of use of the respective garment. The shape of each hanger includes a specific day of the week that is incorporated into the design. The hanger also includes adjustable clips located along a bottom edge, which enable garments to be clipped there under, and of which the clips do not use a fixed jaw to secure the garments.

5 Claims, 4 Drawing Sheets

TIME ORGANIZING CLOTHES HANGER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of closet organizing, more specifically, a set of clothes hangers that are designed to not only store clothes therein, but also to provide different time organizing information as to the item hanging thereon.

B. Discussion of the Prior Art

As a preliminary note, it should be stated that there is an ample amount of prior art that deals with clothes hangers. As will be discussed immediately below, no prior art discloses a clothes hanger with an organizing system that keeps track of when a garment was last worn or when a garment is to be worn or when a garment is due to be laundered; wherein the organizing system utilizes sliding panels that connect into sliding channels located on the clothes hanger; wherein the sliding panels slide with respect to the sliding channel in order to indicate a particular day, month, and current status of use of the respective garment; wherein the shape of each hanger includes a specific day of the week that is incorporated into the design; wherein the clothes hanger uses an adjustable hook with release, which is able to unlock the adjustable hook in order to remove said hanger from a clothes hanger bar; wherein the hanger also includes adjustable clips located along a bottom edge, which enable garments to be clipped there under; and of which the clips do not use a fixed jaw to secure the garments, and of which the adjustable clips slide on a track integrated into the bottom edge in order to secure different size and types of garments.

The Zuckerman Patent (U.S. Pat. No. 6,202,906) discloses a clothes hanger with clips on the bottom of it. However, the clothes hanger does not include a adjustable hook with release, and also does not include adjustable clips which slide on a track to attach garments. Additionally, the clips press against a fixed jaw of the clip to secure garments.

The Housley Patent (U.S. Pat. No. 6,612,000) discloses a hanger for clothes with clips on the bottom. However, the clothes hanger does not include a adjustable hook with release, and also does not include adjustable clips which slide on a track to attach garments. Additionally, the clips press against a fixed jaw of the clip to secure garments.

The Zuckerman Patent (U.S. Pat. No. 5,305,933) discloses a clothes hanger with a tab for holding information. However, the clothes hanger does not have a sliding panel for keeping track of garment use, and also does not include a adjustable hook with release. Additionally, the information on the tab is irremovable and cannot be changed once affixed to the hanger.

The Collum Patent (U.S. Pat. No. 3,124,284) discloses a tab system on a clothes hanger used to determine whether or not a garment is ready to be washed. However, the clothes hanger does not have a sliding panel for keeping track of garment use, and also the shape of the clothes hanger is not a specific day of the week used to keeping track of garment wear. Additionally, the clothes hanger does not include adjustable clips on a sliding track to attach the garments.

The Norman et al. Patent (U.S. Pat. No. 5,096,101) discloses a garment hanger with a locking information tab. However, the clothes hanger does not have a sliding panel for keeping track of garment use, and also does not include a adjustable hook with release. Additionally, the information on the tab is irremovable and cannot be changed once affixed to the hanger.

The Yau Patent (U.S. Pat. No. Des. 527,194) discloses a design for an information tab mount for hanger. However, the clothes hanger does not have a sliding panel for keeping track of garment use, and also does not include a adjustable hook with release. Additionally, the information on the tab is irremovable and cannot be changed once affixed to the hanger.

The Fleming Patent Application Publication (U.S. Pub. No. 2007/0084889) discloses an information tab system for hangers. However, the clothes hanger does not have a sliding panel for keeping track of garment use, and also does not include a adjustable hook with release.

The Russo Patent Application Publication (U.S. Pub. No. 2005/0224532) discloses a hanger system that has information on it for last worn, last cleaned, and number of times worn. However, record indicators do not use a sliding panel for keeping track of the information, and also the hanger does not utilize sliding channels into which the sliding panels keep track of garment wear information. Additionally, the shape of the clothes hanger is not a specific day of the week used to keeping track of garment wear.

While the above-described devices fulfill their respective and particular objects and requirements, they do not describe a clothes hanger with an organizing system that keeps track of when a garment was last worn or when a garment is to be worn or when a garment is due to be laundered; wherein the organizing system utilizes sliding panels that connect into sliding channels located on the clothes hanger; wherein the sliding panels slide with respect to the sliding channel in order to indicate a particular day, month, and current status of use of the respective garment; wherein the shape of each hanger includes a specific day of the week that is incorporated into the design; wherein the clothes hanger uses an adjustable hook with release, which is able to unlock the adjustable hook in order to remove said hanger from a clothes hanger bar; wherein the hanger also includes adjustable clips located along a bottom edge, which enable garments to be clipped there under; and of which the clips do not use a fixed jaw to secure the garments, and of which the adjustable clips slide on a track integrated into the bottom edge in order to secure different size and types of garments. In this regard, the time organizing clothes hanger departs from the conventional concepts and designs of the prior art.

SUMMARY OF THE INVENTION

The time organizing clothes hanger involves a system for hanging garments, which also keeps track of when a garment was last worn or when a garment is to be worn or when a garment is due to be laundered. The time organizing system utilizes sliding panels that connect into and slide along sliding channels located on the clothes hanger. The sliding panels keep track of and indicate a particular day, month, and current status of use of the respective garment. The shape of each hanger includes a specific day of the week that is incorporated into the design. The clothes hanger uses an adjustable hook with release, which is able to unlock the adjustable hook in order to remove said hanger from a clothes hanger bar. The hanger also includes adjustable clips located along a bottom edge, which enable garments to be clipped there under, and of which the clips do not use a fixed jaw to secure the garments. The adjustable clips slide on a track integrated into the bottom edge in order to secure different size and types of garments.

An object of the invention is to provide a set of time organizing clothes hangers wherein each hanger includes a particular day of the week, and which is integrated into the body of the respective clothes hanger.

A further object of the invention is to provide a plurality of sliding panels that lock into and slide along sliding channels, which thus enables the sliding panels to keep track of and indicate a particular data or status of use of a garment secured thereon.

A further object of the invention is to provide a plurality of adjustable hooks that can clip onto a garment in order to secure a garment from there under.

These together with additional objects, features and advantages of the time organizing clothes hanger will be readily apparent to those of ordinary skill in the art upon reading the following detailed description of presently preferred, but nonetheless illustrative, embodiments of the time organizing clothes hanger when taken in conjunction with the accompanying drawings.

In this respect, before explaining the current embodiments of the time organizing clothes hanger in detail, it is to be understood that the time organizing clothes hanger is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the time organizing clothes hanger.

It is therefore important that the claims be regarded as including such equivalent construction insofar as they do not depart from the spirit and scope of the time organizing clothes hanger. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
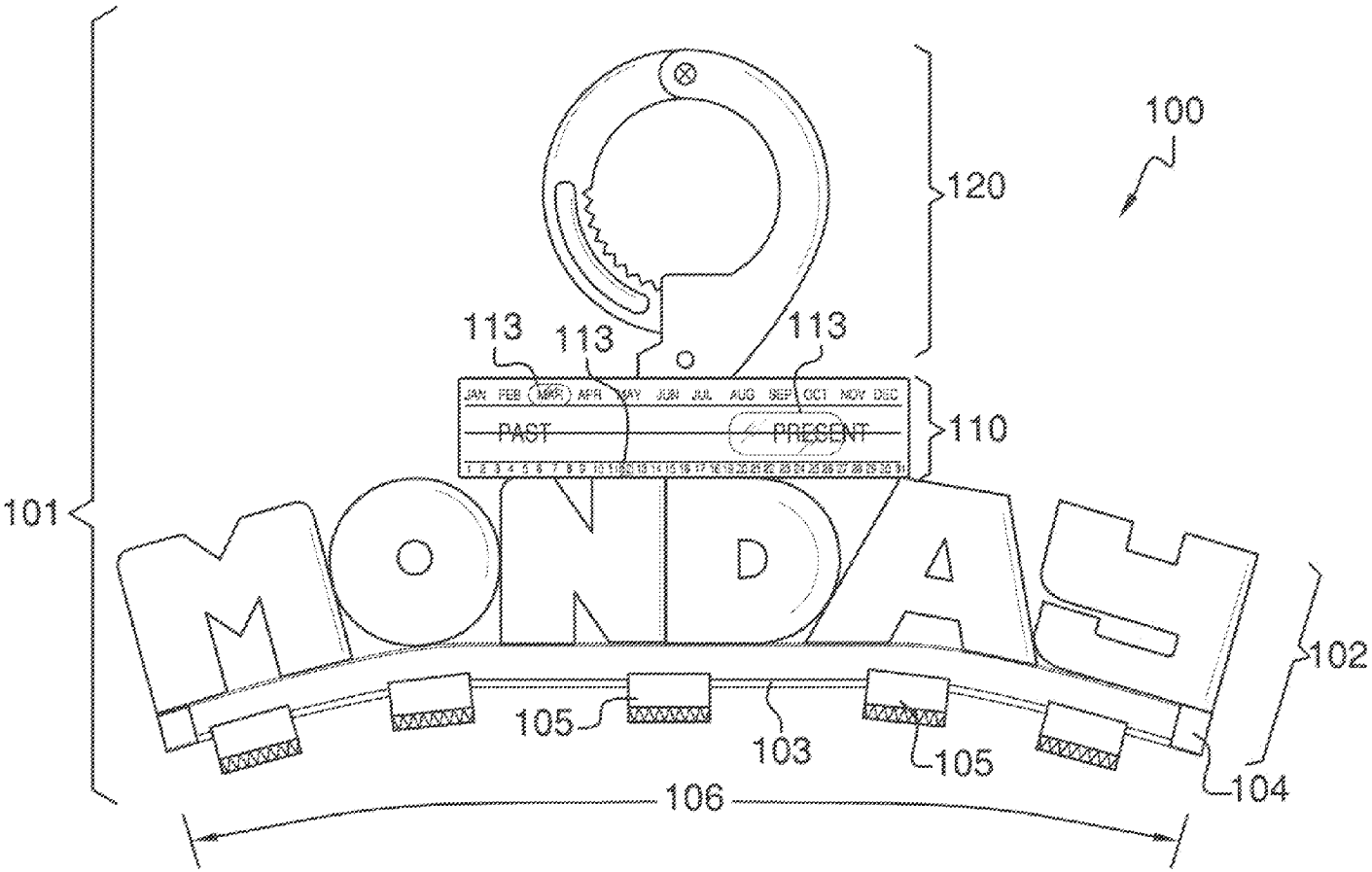
FIG. 1 illustrates a front view of the "MONDAY" clothes hanger of the time organizing clothes hanger.
Figure 2:
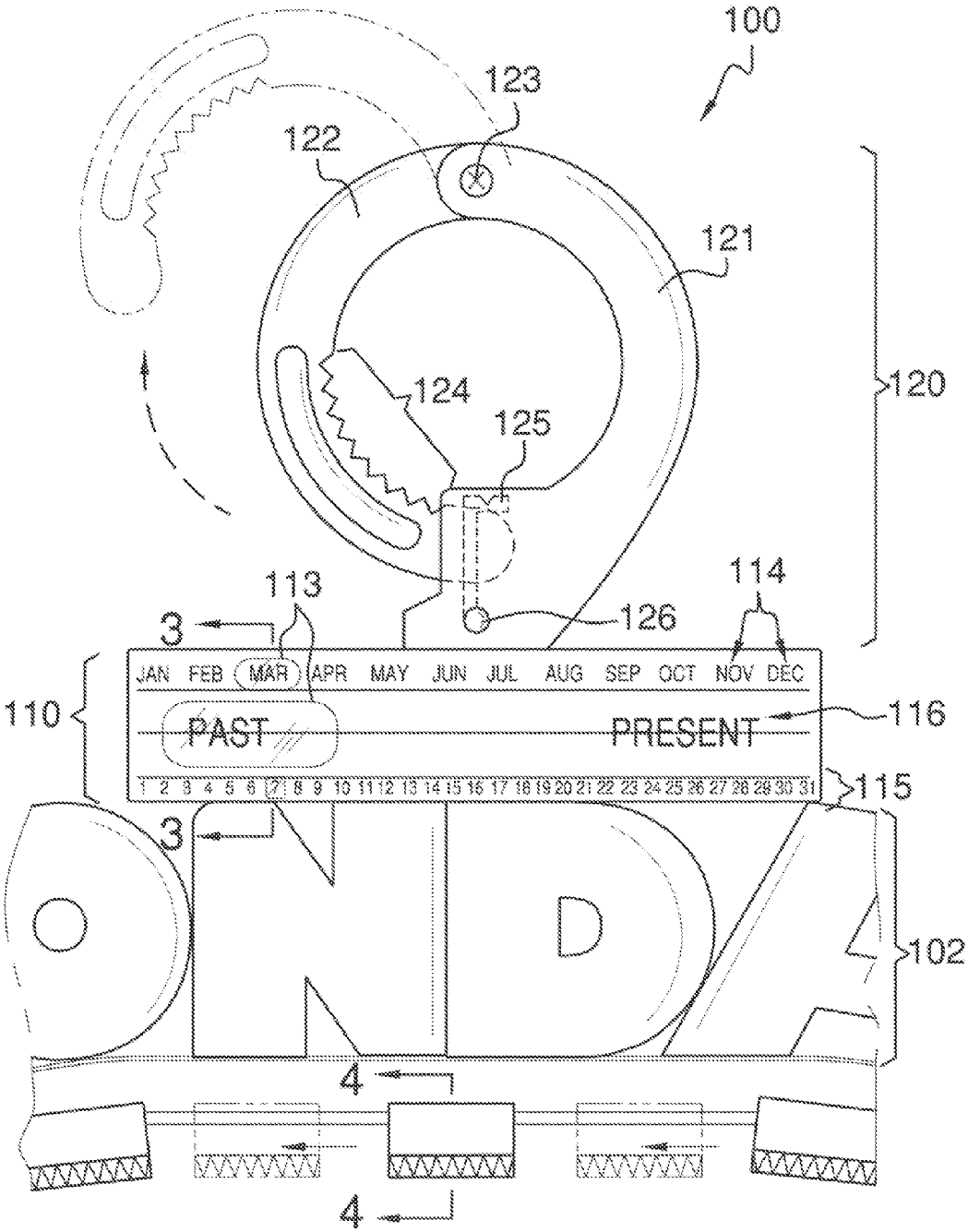
FIG. 2 illustrates a close up front view of the "MONDAY" clothes hanger wherein the adjustable hook is rotating open as well as movement of the adjustable clips along the bottom edge of the respective clothes hanger.
Figure 3:
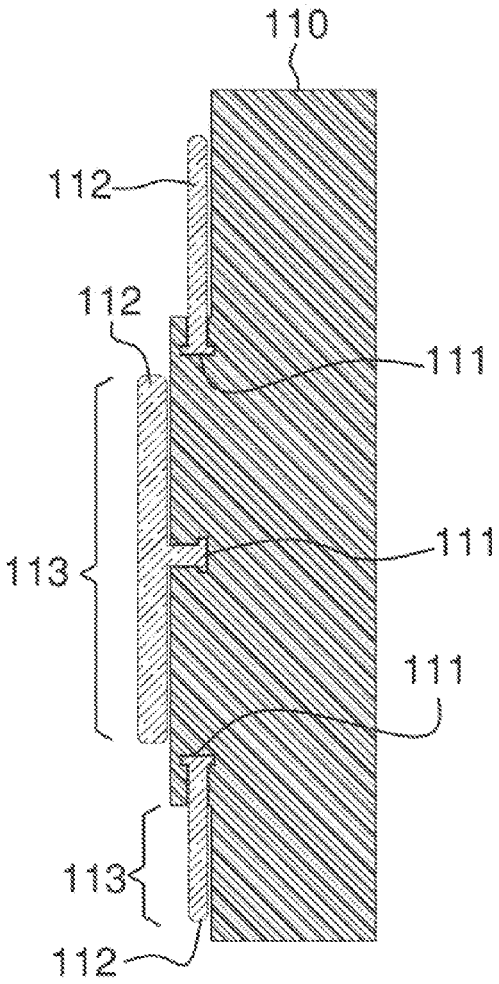
FIG. 3 illustrates a cross-sectional view of the time organizing clothes hanger along line 3-3 in FIG. 2, and detailing the inter-spatial relationship between the sliding panels and the sliding channel.
Figure 4:
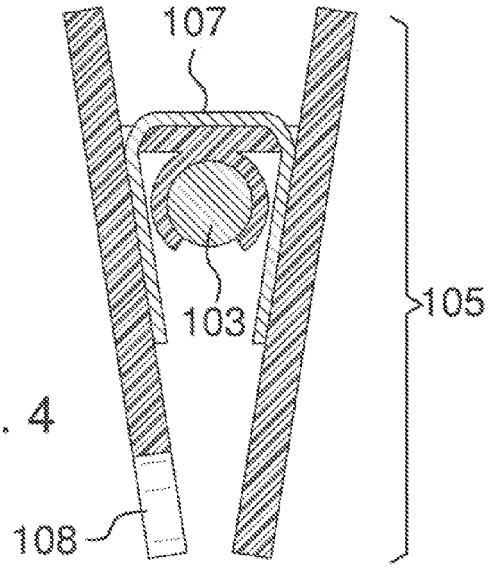
FIG. 4 illustrates another cross-sectional view of the time organizing clothes hanger along line 4-4 in FIG. 2, and depicting the adjustable clip slidably engaged along the track integrated into the bottom edge as well as the spring used to bias the adjustable clip.
Figure 5:
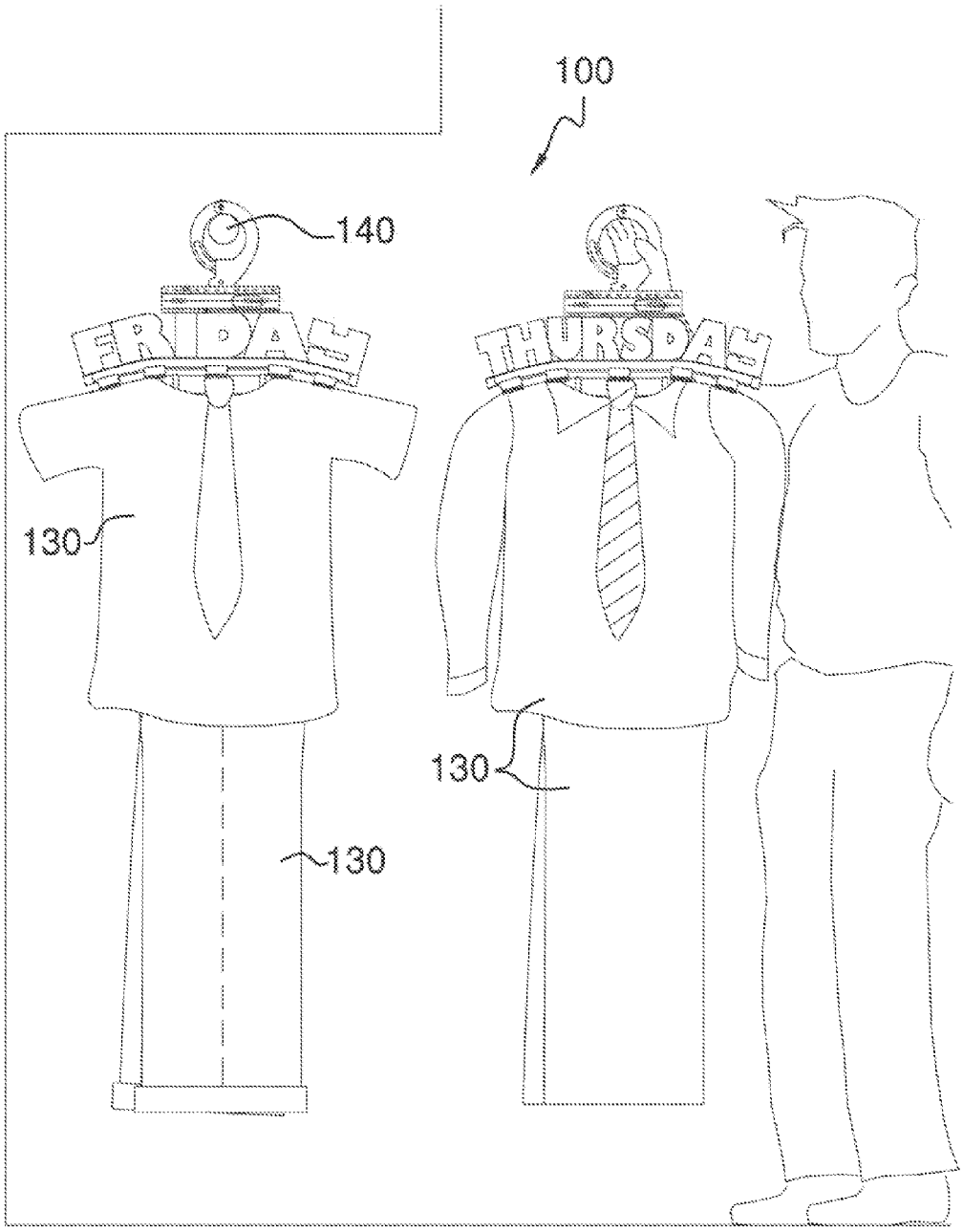
FIG. 5 illustrates a view of the time organizing clothes hanger in use wherein the "FRIDAY" clothes hanger is suspended on a closet hanger rod, and an end user is holding a "THURSDAY" clothes hanger with garments secured thereon.

Detailed reference will now be made to the preferred embodiment of the present invention, examples of which are illustrated in FIGS. 1-5. A time organizing clothes hanger 100 (hereinafter invention) includes a set of clothes hangers that are individually specific to a particular day of the week. In other words, each clothes hanger 101 includes a day of the week integrated into the body 102 of the clothes hanger 101 such that a "MONDAY" is spelled out along the body 102 of the clothes hanger 101 (see FIGS. 1 and 5).

The body 102 portion of the clothes hanger 101 includes a track 103 integrated into a bottom edge 104. The track 103 supports a plurality of adjustable clips 105 thereon. The adjustable clips 105 are able to slide along a length 106 of the track 103. The adjustable clips 105 each include a spring 107, which imposes a biasing force that directs teeth 108 of the adjustable clips 105 inwardly, and in order to grab onto and hold a garment 130 there under. It shall be noted that the adjustable clips 105 may be used in lieu of or in addition to the body 102 portion of the clothes hanger 101 in order to support more than one garment 130 thereon.

Located above the body 102 portion of the clothes hanger 101 is a panel member 110, which is generally rectangular, and includes sliding channels 111 integrated thereon. The sliding channels 111 are includes in order for sliding panels 112 to slide thereon. The sliding panels 112 include a clear member 113 that can indicate a particular date or status of the garment 130 supported there under. The sliding panels 112 slide across months 114, day 115, and status 116. It shall be noted that the term "status" 116 is being used to indicate whether the garment 130 is okay to be worn now or in the future or is due to be laundered. Moreover, the "status" 116 is represented as "PAST" and "PRESENT" in the figures.

Located above the panel member 110 is an adjustable hook 120, which is comprises of a fixed hook member 121 from which a pivoting hook member 122 is rotatably engaged about a pivot point 123. The pivoting hook member 122 includes a plurality of hook teeth 124 that engages a spring-loaded locking member 125 that is released upon depression of a release button 126 located on the fixed hook member 121. The adjustable hook 120 is located with the invention 100 in order to lock the respective clothes hanger 101 onto a closet hanger rod 140 or other stationary object associated with hanging up a clothes hanger thereon. The clothes hanger 101 cannot become unhooked from the closet hanger rod 140 until the adjustable hook 120 is released, and rotated open in order to remove the adjustable hook 120 from the closet rod hanger 140.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A time organizing clothes hanger kit comprising:

a set of clothes hanger upon a body of each of which is included a designated day of week thereby forming a full set that includes at least seven clothes hangers each of which is designated and assigned to a particular day of the week;

wherein each clothes hanger includes a plurality of adjustable clips that slide along a track provided on a bottom edge;

wherein a panel member extends up from the body portion and includes a plurality of sliding panels that indicate a particular status or date of use of a garment secured to said clothes hanger;

wherein each clothes hanger includes an adjustable hook that opens and closes to form a hook for adaption and use with a closet rod hanger;

wherein the adjustable clips slide along a length of the track;

wherein the adjustable clips each include a spring, which imposes a biasing force that directs teeth of the adjustable clips inwardly, and in order to grab onto and hold a garment there under;

wherein the panel member is generally rectangular, and includes sliding channels integrated thereon; wherein the sliding channels are included in order for sliding panels to slide thereon; wherein the sliding panels include a clear member that can indicate a particular date or status of the garment supported there under; wherein the sliding panels slide across months, days, and the status.

2. The time organizing clothes hanger as described in claim 1 wherein the clothes hangers include the spelling of the word of the respective day of the week upon the body of the clothes hanger.

3. The time organizing clothes hanger as described in claim 1 wherein the adjustable hook includes a fixed hook member from which a pivoting hook member is rotatably engaged about a pivot point.

4. The time organizing clothes hanger as described in claim 3 wherein the pivoting hook member includes a plurality of hook teeth that engages a spring-loaded locking member that is released upon depression of a release button located on the fixed hook member.

5. A time organizing clothes hanger kit comprising:

a set of clothes hanger upon a body of each of which is included a designated day of week thereby forming a full set that includes at least seven clothes hangers each of which is designated and assigned to a particular day of the week;

wherein each clothes hanger includes a plurality of adjustable clips that slide along a track provided on a bottom edge;

wherein a panel member extends up from the body portion and includes a plurality of sliding panels that indicate a particular status or date of use of a garment secured to said clothes hanger;

wherein each clothes hanger includes an adjustable hook that opens and closes to form a hook for adaption and use with a closet rod hanger;

wherein the clothes hangers include the spelling of the word of the respective day of the week upon the body of the clothes hanger;

wherein the adjustable clips slide along a length of the track;

wherein the adjustable clips each include a spring, which imposes a biasing force that directs teeth of the adjustable clips inwardly, and in order to grab onto and hold a garment there under;

wherein the panel member is generally rectangular, and includes sliding channels integrated thereon; wherein the sliding channels are included in order for sliding panels to slide thereon; wherein the sliding panels include a clear member that can indicate a particular date or status of the garment supported there under; wherein the sliding panels slide across months, days, and the status;

wherein the adjustable hook includes a fixed hook member from which a pivoting hook member is rotatably engaged about a pivot point;

wherein the pivoting hook member includes a plurality of hook teeth that engages a spring-loaded locking member that is released upon depression of a release button located on the fixed hook member.

* * * * *